US012509824B2

(12) United States Patent
Gscheider

(10) Patent No.: US 12,509,824 B2
(45) Date of Patent: Dec. 30, 2025

(54) PULP SCREENING MACHINE

(71) Applicant: ANDRITZ (China) Ltd., Guangdong (CN)

(72) Inventor: Alexander Gscheider, Hohentauern (AT)

(73) Assignee: ANDRITZ (China) Ltd., Guangdong (CN)

( * ) Notice: Subject to any disclaimer, the term of this patent is extended or adjusted under 35 U.S.C. 154(b) by 655 days.

(21) Appl. No.: 17/896,477

(22) Filed: Aug. 26, 2022

(65) Prior Publication Data

US 2023/0060771 A1 Mar. 2, 2023

(30) Foreign Application Priority Data

Sep. 1, 2021 (CN) ..... 202111021322.0

(51) Int. Cl.
*D21D 5/06* (2006.01)

(52) U.S. Cl.
CPC ..... *D21D 5/06* (2013.01)

(58) Field of Classification Search
CPC ..... D21D 5/06
USPC ..... 162/232
See application file for complete search history.

(56) References Cited

U.S. PATENT DOCUMENTS

| | | | | |
|---|---|---|---|---|
| 5,064,125 | A | 11/1991 | Hautala | |
| 5,647,128 | A | 7/1997 | Aikawa | |
| 5,884,774 | A | 3/1999 | Aikawa | |
| 6,550,620 | B2 | 4/2003 | Fukudome et al. | |
| 6,669,028 | B2 | 12/2003 | Aikawa | |
| 2015/0048020 | A1* | 2/2015 | Hamelin | D21D 5/06 210/415 |

FOREIGN PATENT DOCUMENTS

| | | | |
|---|---|---|---|
| CN | 201648840 | U | 11/2010 |
| WO | 2021180090 | A1 | 9/2021 |

OTHER PUBLICATIONS

European Search Report dated Jan. 27, 2023 for European Patent Application No. 22188136.0.

* cited by examiner

*Primary Examiner* — Jacob T Minskey
(74) *Attorney, Agent, or Firm* — Alix, Yale & Ristas, LLP

(57) ABSTRACT

A pulp screening machine has screen extending upward from the bottom of the pulp screening machine and a rotor which rotates around the outside of the screen. An accept outlet is provided inside the screen and a pulp outlet and reject outlet are provided outside of the screen. The rotor vanes of the rotor are cantilevered from the rotor base on top of the screen into the region of the screen, with the rotor vanes not being connected to each other in the region of the screen. The rotor vanes have a rigidity adaptable for de-flaking cooperatively with the outside surface of the screen.

16 Claims, 4 Drawing Sheets

PULP SCREENING MACHINE

BACKGROUND

The disclosed embodiments relate to a pulp screening machine for screening the fiber suspension.

Fiber suspension screening is a common process in the paper industry and especially important for recycled fibers. For different applications different types of screens are in use.

For furnishes of high strength and high slushing resistance (containing for example unbleached kraft fibers), disc-type screens are mainly in use. Such screens are commonly comprising a flat screen plate and a disc type rotor with several vanes. Screens with such designs can provide better de-flaking efficiency than basket type screens. Although these disc type screens require higher power, those are still widely used as the fiber yield can be increased.

Besides high power consumption (mainly due to high rotor tip speed), the disc type screens have many disadvantages in other respects. On one hand is fast wearing of the rotor and the screen plate (and even the machine housing) and a capacity reduction rather fast due to related wearing. Reasons are that the conditions at the screen plate are changing from inside (close to the hub) to the outer area of the screen plate as the tip speed is a function of the radius. Higher throughput in the outer area is the logical result, but due to higher tip speed in the outer area, also the wearing is the fastest there. Another disadvantage is that relatively large machines are required, due to the fact, that a flat screen plate has relatively small screening area compared to a basket type screen.

FIGS. 7 and 8 illustrate the in-flow pulp screening machine according to the conventional art, in which the rotor vanes are provided outside the basket type screen. The rotor vanes are usually with some sort of Hydro-foil design and very gentle. In FIGS. 7 and 8, relatively thicker arrows R indicate the rotation direction of the screen, while the relatively thin arrows F show the flow into and out from the screen caused by the Hydro-foil design of the rotor vanes 101. The rotor vanes are connected to each other via rings 103, as shown in FIG. 7. Such design avoids the rotor vanes cantileveredly extending out, and thus ensures the position stability of the rotor vanes, but it is not suitable for the pulp immediately after coarse screening, because the rings 103 cause tangling and accumulation of the impurities. Hence, such design adapts for the scenario that does not require significant de-flaking. In other words, such a design requires the feed pulp to contain fewer coarse impurities. Such design screens are used in paper machine approach flow screening or in fine screening systems (after a coarse screening has been applied already).

SUMMARY

To overcome said shortcomings of the state of art, the disclosed embodiments provide a pulp screening machine, comprising a screen which extends upwards from the bottom of the pulp screening machine, and a rotor which rotates around the outside of the screen, wherein the accept outlet is provided inside of the screen, the pulp inlet and the reject outlet are provided outside of the screen, wherein the rotor vanes of the rotor cantileveredly extend from the rotor base on top of the screen into the region of the screen, with the rotor vanes not being connected to each other in the region of the screen, wherein the rotor vanes have a rigidity adaptable for de-flaking cooperatively with the outside surface of the screen.

Distinguishing from the state of art, the pulp screening machine in the disclosed embodiments replace the flat screen plate with a basket type screen. The rotor is designed in a similar foil-type geometry, but the rotor vanes are provided outside of the screen. As the pulp inlet is provided outside of the screen and the accept outlet is provided inside of the screen, the accept flows to the inside of the screen, whereas the rejects are kept outside of the pulp screening machine and removed away from the pulp screening machine preferably in a tangential direction from the reject outlet provided outside the screen. Compared to known systems in which the pulp inlet is provided inside of the screen and accept outlet is provided outside of the screen, the disclosed "in-flow" operating design according to this invention brings the beneficial effect that it reduces wearing to the screen inside due to the centrifugal forces. Therefore, the coarse heavies, which will cause severe wearing to the screen, will no longer stay inside the screen. Moreover, coarse heavies could be gathered by a junk trap tangentially provided on the housing of the pulp screening machine.

The inventor has discovered that with the rotor vanes cantileveredly extending into the region of the screen and not connected to each other, and no ring being provided, the tangling and accumulation of the impurities can be avoided to the largest extent. In the meantime, the rotor vanes thus have some flexibility in that unslushed paper flakes (fiber bundles) can be de-flaked between the cantilevered rotor vanes and the screen. Therefore, the pulp screening machine of the present invention can be used for processing the pulp immediately after the pulping step as a so called coarse screening system, so as to further de-flake the pulp and remove coarse impurities at lowest fiber losses.

The screen of the pulp screening machine could be cylindrical, which extends vertically upwards, or it could also be conical, which gradually widens up or tapers down as extending upwards. The rotor vanes are designed with a matched shape respectively so that it can sweep over the surface of the screen. The screen angle $\alpha$ between the screen of the pulp screening machine and the horizontal plane can be greater than 90°, and less than or equal to 135°. Alternatively the screen angle $\alpha$ between the screen of the pulp screening machine and the horizontal plane can be greater than or equal to 45°, and less than 90°. Or the screen angle $\alpha$ between the screen of the pulp screening machine and the horizontal plane is in the range of 90° to 105°. Alternatively the screen angle $\alpha$ between the screen of the pulp screening machine and the horizontal plane is in the range of 75° to 90°.

According to a preferable embodiment of the pulp screening machine, projecting strips are provided on the outside surface of the screen of the pulp screening machine. The projecting strips are preferably made from wear resistant material which shows good wearing resistance to further enhance de-flaking and avoiding accumulation of rejects between rotor and basket. The strips are preferably provided with sharp edges which enhance de-flaking and keep the power low. The strips could be a separate part welded or bolted or mounted by means of both welding and bolting on the outside surface of the screen, or integrated on the outside surface of the screen.

Preferably, the projecting strips on the outside of the screen surface are provided angled to the front edge of the rotor vane. Further preferably, the angle between the strips and the front edge of the rotor vane is larger than 90 degrees.

Of course, the strips and the vanes could also be provided vertically or in other angles. Angles >90 degrees reduces wearing, whereas angles <90 degrees improving de-flaking efficiency.

Preferably, on the outside surface of the screen of the pulp screening machine, the strips extend across approximately the same range in the height of screen as each front edges of the rotor vanes does. Thus de-flaking effects of the screen is enhanced at its total height.

Each strip could be designed as a single strip which extends across the screen height. But preferably, several groups of the strips are provided on the outside surface of the screen of the pulp screening machine, together extend across the height of the screen.

Furthermore, the projecting strips could be replaced by the concave grooves on the outside surface of the screen to allow the rotor vanes mounted closer to screens, so that the pulp screening machine is provided with better de-flaking effect and higher throughput.

Obviously, instead of through grooves, the grooves are provided with bottom. Projecting strips are provided on the place without screening holes or slots, but grooves could be also used at the perforated area—means more open area is provided, which means increase throughput.

According a preferred embodiment, the widths of the grooves are increasing from the feed side of the screen to the reject discharge side. Due to the "wiping effect," the amount of collected impurities on the rotor vane front edge will increase from the top (feed side) of the screen to bottom (reject side). The increased grooves width from the top of the screen to the bottom adapts to such increasing amount of collected impurities.

According to one of the preferred embodiments, the depths of the grooves increase from the feed side of the screen to the reject discharge side. Due to the "wiping effect," the amount of collected impurities on the rotor vane front edge will increase from the top (feed side) of the screen to bottom (reject side). The increased grooves depth from top of the screen to the bottom adapts to such increasing amount of collected impurities.

According to one of the preferred embodiments, the widths and depths of the grooves increase from the feed side of the screen to the reject discharge side. Due to the "wiping effect," the amount of collected impurities on the rotor vane front edge will increase from the top (feed side) of the screen to bottom (reject side). The increased grooves width and depth from top of the screen to the bottom adapts to such increasing amount of collected impurities.

Similarly, concave grooves on the outside surface of the screen of the pulp screen machine are provided angled to the front edge of the rotor vane. Further preferably, the angle between the grooves and the front edge of rotor vane is larger than 90 degrees. It is no doubted that the grooves and the vanes could also be provided vertically or in other angles.

Preferably, on the outside surface of the screen of the pulp screening machine, the concave grooves approximately extend across the same range in the height of screen as each front edge of the rotor vane does. Thus de-flaking effects of the screen is enhanced at its total height.

Each groove could be designed as a single groove which stretches across the whole height of the screen. But preferably is that several groups of the grooves are provided on the outside surface of the screen of the pulp screening machine, together extend across the height of the screen.

The screen is perforated screen or slotted screen. For the slotted screen, the slots are preferably provided angled to the front edge of the rotor vane. The slots are provided angled to the front edge of the rotor vane. Thus the transportation capacity of the pulp and reject from the pulp inlet to the reject outlet is enhanced and meanwhile the screen basket is kept clean.

The advantages provided by the disclosed embodiments include: Firstly, compared with flat screen plate, the ratio of the provided screen area to the size of the pulp screening machine is remarkably increased. For same volume capacity, a smaller machine can be used. Secondly, due to utilizing the screen area in a better way with lower tip speed, the power consumption is reduced. Meanwhile, the wearing of the screen caused by centrifugal force is reduced remarkably because of lower tip speed and applied in-flow principle, and heavies are moved away from the outside of the screen instead of staying at the inside of the screen. It is also easier to change rotors or rotor vanes because the rotors are provided outside of the screen.

DETAILED DESCRIPTION

Figure 1:
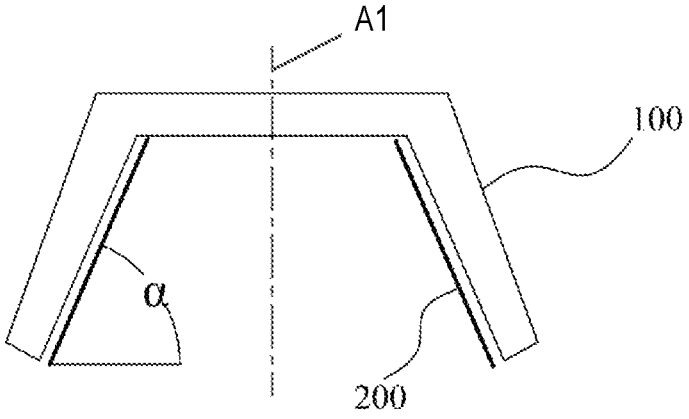
FIG. 1 schematically shows a section view of an embodiment of the pulp screening machine, wherein only the screen and the rotor are presented.

FIG. 1 schematically shows a side section view in an embodiment of a pulp screening machine, wherein only the basket type screen and the rotor are presented. As FIG. 1 shows, the screen 200 of the pulp screening machine is conical which gradually tapers inward (narrows) as it extends upwards. The rotor 100 rotates about the axis A1 around the outside of the screen 200, wherein the accept outlet (not shown) is provided inside the screen 200, the pulp inlet (not shown) and the reject outlet (not shown) are provided outside the screen 200.

Figure 2:
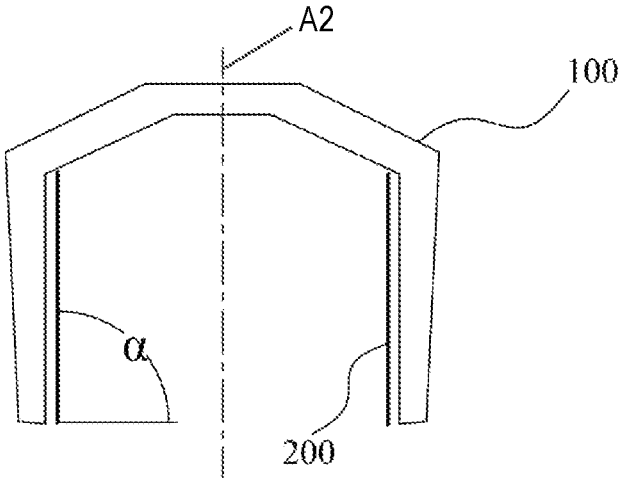
FIG. 2 schematically shows a section view of another embodiment of the pulp screening machine, wherein only the screen and the rotor are presented.

FIG. 2 schematically shows a side section view of another embodiment of the disclosed pulp screening machine, wherein only the screen and the rotor are presented. As FIG. 2 shows, the screen 200 of the pulp screening machine is cylindrical which extends vertically upwards. The Rotor 100 rotates around the outside of the screen 200 about the axis A2.

Figure 3:
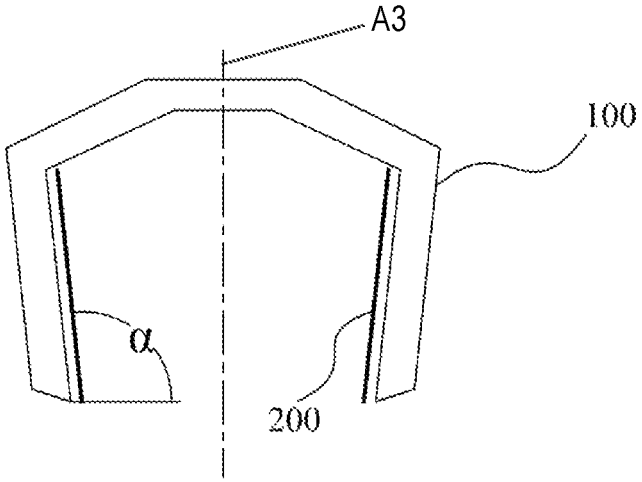
FIG. 3 schematically shows a section view of a further embodiment of the pulp screening machine, wherein only the screen and the rotor are presented.

FIG. 3 schematically shows the section view in a further embodiment of pulp screening machine according to the present invention, wherein only the screen and the rotor are presented. As FIG. 3 shows, screen 200 of the pulp screening machine is conical which gradually tapers outward (widens) as extending upwards. The Rotor 100 rotates around the outside of the screen 200 about the axis A3.

The screen angle $\alpha$, which refers to the angle between the screen and a horizontal plane shown in FIGS. 1 to 3, is preferably within the range of 45° to 135°, and more preferably 75° to 105°, which is subject to the applied furnishes and application conditions. It has been found that an angle <90° enhances the de-flaking, whereas the angle >90° improves the accept quality.

At comparable de-flaking efficiency, the tip speed of the pulp screening machine can be reduced by up to 30%, thereby reducing the power consumption remarkably and additionally prolonging the life of the basket and the rotor.

Figure 4:
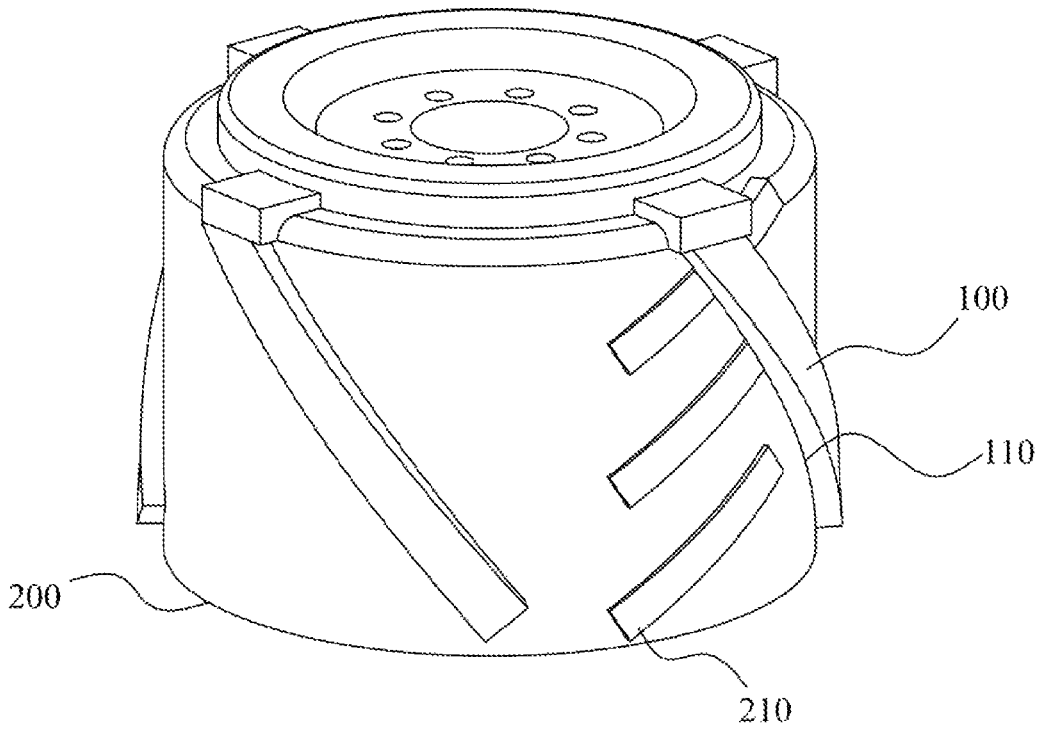
FIG. 4 schematically shows an embodiment of the rotor and the screen of the disclosed pulp screening machine.

FIG. 4 schematically shows the rotor and the screen of the pulp screening machine in isometric view. As FIG. 4 shows, the rotor 100 is designed around the outside of the screen 200. Projecting strips 210 are provided on the outside surface of the screen 200. Strip 210 is applied to improve the de-flaking efficiency and to avoid the accumulation of the rejects (impurities) between the rotor 100 and screen 200. In different embodiments, strips can also be replaced with grooves to reach similar technical effects.

Figure 5:
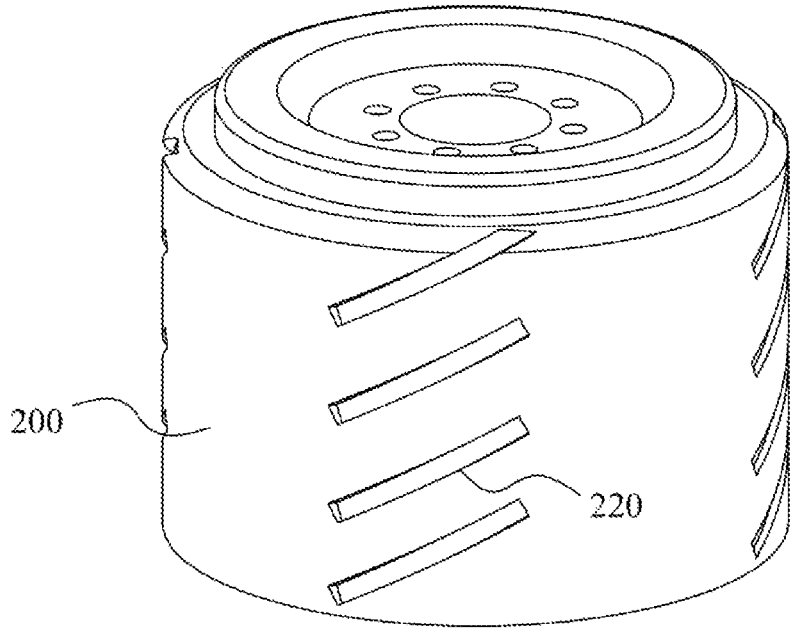
FIG. 5 schematically shows the projecting strips outside the screens of the pulp screening machine.

FIG. 5 schematically shows another embodiment of a rotor and the screen 200 of the pulp screening machine in isometric view. In this embodiment, the screen 200 includes concave grooves 220 on its outside surface.

Depending on the applied furnishes and application conditions, the embodiment with slotted baskets of FIG. 5 can be used instead of the embodiment with projecting strips of FIG. 4, resulting in better accept quality at still high de-flaking efficiency. The slots 230 are provided angled to the rotation axis, which enhances the transportation of the slurry and impurities from feed to reject side and keeps the screen basket clean.

Figure 6:
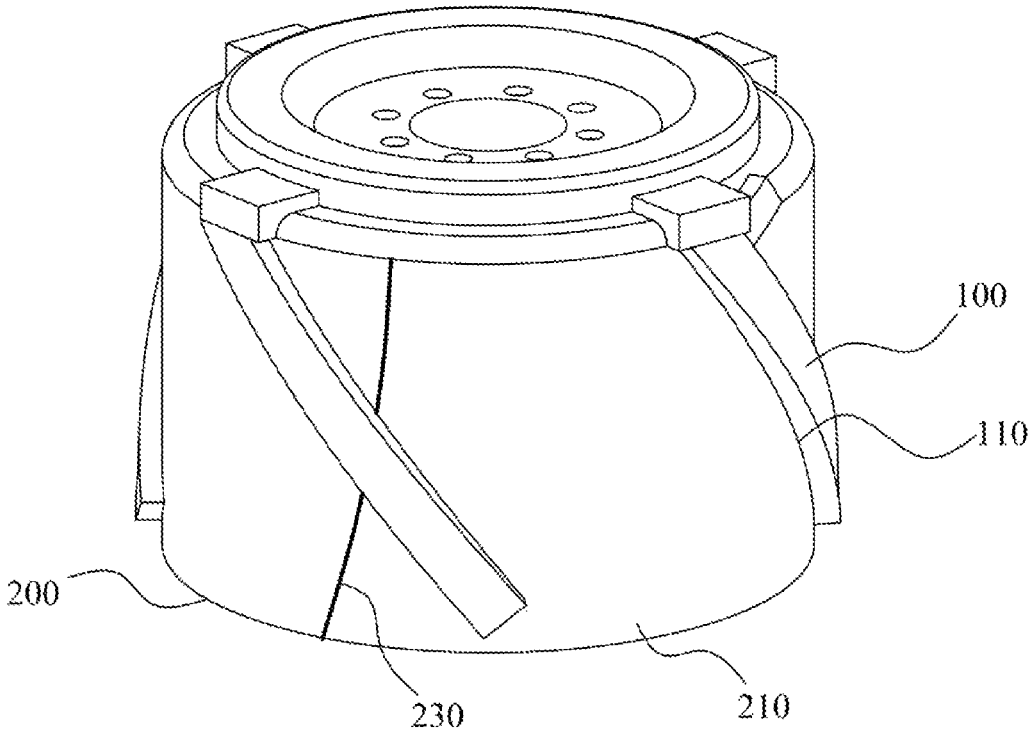
FIG. 6 schematically shows the screen and the rotor as disclosed herein.
Figure 7:
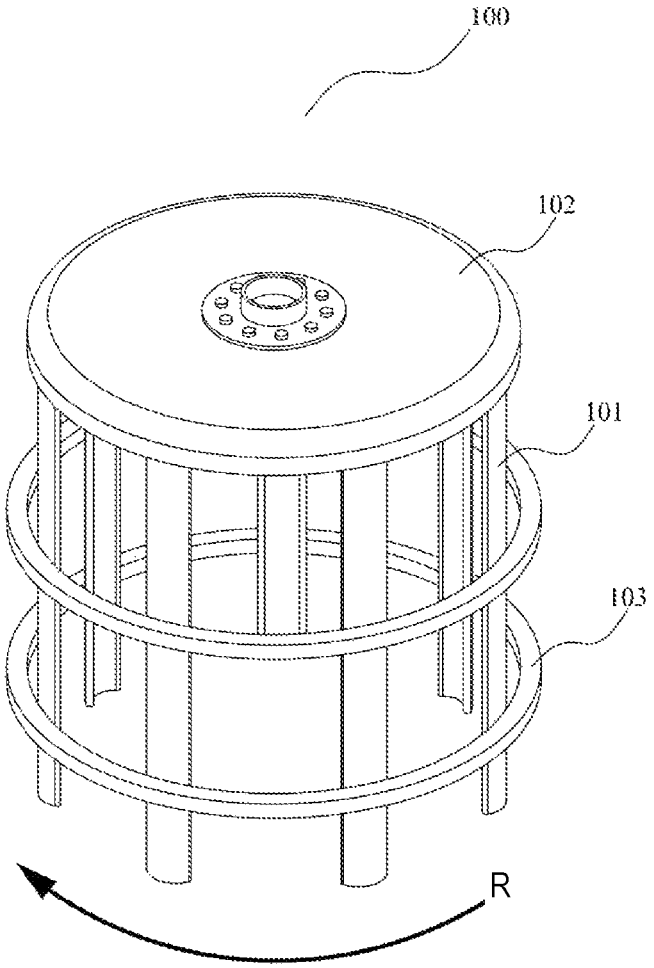
Fig. 7 (Prior Art)
FIGS. 7 and 8 illustrate the in-flow pulp screening machine according to the prior art.
Figure 8:
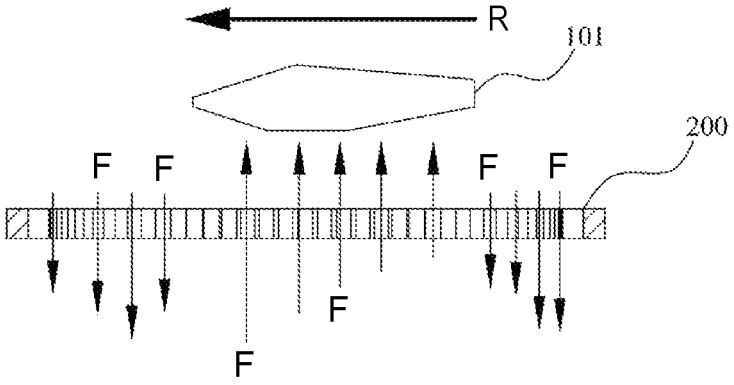
Fig. 8 (Prior Art)

FIG. 6 schematically shows an embodiment of the disclosed screen 200 and the rotor 100, wherein the screen 200 is slotted. One of the slots 230 on the outside surface of the screen 200 is shown in FIG. 6, which is provided angled to the front edge 110 of the rotor vane.

The above discloses the preferable embodiments of this invention, while the spirit and scope of this invention are not limited within the specific contents disclosed here. Those skilled in the art can develop more embodiments and applications according to teaching of this invention, and these embodiments and applications also belong to the spirit and scope of this invention. Therefore, it could be understood that the specific embodiments do not further limit the spirit and scope of this invention, which is defined by the claims.

REFERENCE NUMBER LIST

100 rotor
101 rotor vane
102 rotor base
103 ring
110 front edge of the rotor vane
200 screen
210 projecting strip
220 concave grooves
230 slot

What is claimed is:

1. A pulp screening machine, comprising:

a screen (200) extending upwards from a bottom and defining an inside and an outside, a rotor (100) rotatable about the outside of the screen (220) and including rotor vanes (101) cantilevered from a base (102) thereof from a top of and into the inside of the screen (200), an accept outlet provided on the inside of the screen (200), a pulp inlet and a reject outlet provided on the outside the screen (200), wherein the screen (200) is conical, tapering inward as extending upwards, the rotor vanes (101) are not connected to each other on the inside of the screen (200), the rotor vanes have a rigidity adaptable for de-flaking the pulp cooperatively with the screen, and a screen angle $\alpha$ between the screen (200) and a horizontal plane is greater than or equal to 45° and less than 90°.

2. The pulp screening machine (100) according to claim 1, further comprising projecting strips (210) provided on an outside surface of the screen (200).

3. The pulp screening machine according to claim 2, wherein at least one of the projecting strips (210) on the outside surface of the screen (200) is angled relative to a front edge (110) of the rotor vanes.

4. The pulp screening machine according to claim 2, wherein the projecting strips (210) extend across a distance in the height of the screen (200) that is equal to a distance that each front edge (110) of the rotor vanes extends on the outside surface of the screen (200), and the projecting strips (210) extend across a height of the screen (200) that is equal to the distance that each front edge (110) of the rotor vanes extends.

5. The pulp screening machine according to claim 2, wherein several groups of strips (210) are provided on the outside surface of the screen (200) and together extend across the height of the screen.

6. The pulp screening machine according to claim 1, comprising concave grooves (220) provided on an outside surface of the screen (200).

7. The pulp screening machine according to claim 6, wherein the concave grooves (220) are angled to a front edge (110) of the rotor vane.

8. The pulp screening machine according to claim 6, wherein the grooves (220) have widths that increase from a top of the screen (200) toward a bottom of the screen (200).

9. The pulp screening machine according to claim 6, wherein the grooves (220) have depths that increase from a top of the screen (200) toward a bottom of the screen (200).

10. The pulp screening machine according to claim 6, wherein concave grooves (220) on the outside surface of the screen (200) extend a distance in the height of screen (200) that is equal to a distance that each front edge (110) of the rotor vane extends.

11. The pulp screening machine according to claim 6, wherein several groups of the grooves (220) are provided on the outside surface of the screen (200) of the pulp screen machine and together extend across an entire height of the screen.

12. The pulp screening machine according to claim 1, wherein the screen (200) is perforated.

13. The pulp screening machine according to claim 1, wherein the screen (200) is slotted.

14. The pulp screening machine according to claim 13, wherein the slots of the screen (200) are angled relative to the front edge (110) of the rotor vane.

15. The pulp screening machine according to claim 13, wherein the slots of the screen (200) are angled relative to an axis of rotation of the rotor.

16. The pulp screening machine according to claim 1, comprising a junk trap provided tangentially on a housing of the pulp screening machine configured for removing coarse heavies from the pulp.

* * * * *